US005664984A

United States Patent [19]

Laughridge

[11] Patent Number: 5,664,984

[45] Date of Patent: Sep. 9, 1997

[54] BRASSIERE HAVING FRONTAL MOISTURE CONTROL

[76] Inventor: Nancy E. Laughridge, 1105 E. Arch St., Lancaster, S.C. 29720

[21] Appl. No.: 646,846

[22] Filed: May 8, 1996

[51] Int. Cl.[6] ..... A41B 3/12; A41D 27/00; A41D 27/14

[52] U.S. Cl. ..... 450/57; 450/53; 450/56; 2/267; 2/73

[58] Field of Search ..... 450/41, 42, 43, 450/44, 45, 46, 47, 48, 49, 50, 51, 52, 53, 54, 55, 56, 57, 81; 2/73; 11/267

[56] References Cited

U.S. PATENT DOCUMENTS

| | | | |
|---|---|---|---|
| 862,376 | 8/1907 | Bachman | 450/57 |
| 1,970,920 | 8/1934 | Roth | 450/48 |
| 2,480,049 | 8/1949 | Rosenberg | 450/45 |
| 2,568,175 | 9/1951 | Ullrich | 450/54 |
| 2,574,962 | 11/1951 | Curran | 450/48 |
| 2,621,328 | 12/1952 | Duchnofskey . | |
| 2,660,729 | 12/1953 | Katz | 450/48 |
| 2,700,768 | 12/1955 | Kress | 450/48 |
| 2,829,650 | 4/1958 | Guide | 450/49 X |
| 2,875,764 | 3/1959 | Benson . | |
| 2,886,820 | 5/1959 | Morris . | |
| 3,421,515 | 1/1969 | Schaefer . | |
| 5,042,088 | 8/1991 | Sherrod et al. | 2/56 X |
| 5,269,720 | 12/1993 | Moretz et al. . | |
| 5,326,305 | 7/1994 | Fochler | 450/81 X |

*Primary Examiner*—Jeanette E. Chapman
*Attorney, Agent, or Firm*—Bell, Seltzer, Park & Gibson, P.A.

[57] ABSTRACT

There is provided a brassiere having a brassiere body including a torso encircling body portion having a frontal portion, side portion and a back portion, a pair of breast cups located in the front of said body portion, an area connecting said breast cups. A moisture absorbent material is attached to the area between said breast cups. There is also provided a moisture absorbent material including a deodorant. The moisture absorbing material may be readily disposable.

10 Claims, 1 Drawing Sheet

BRASSIERE HAVING FRONTAL MOISTURE CONTROL

BACKGROUND OF THE INVENTION

1. Field of the Invention

The present invention relates to a perspiration and odor-controlling undergarment, namely a brassiere having a perspiration absorbing material attached to an area between the breast cups. More specifically, the present invention relates to a brassiere having a disposable absorbent material attached between breast cups for absorbing and deodorizing perspiration.

2. The Prior Art

It has long been the practice of many women to go to great lengths to eliminate or at least minimize the wetness and odor caused by perspiration. The excretion of moisture from the body through the skin occurs even at rest. For example, a body at rest typically loses up to twelve ounces of water a day. However, during a reasonably active day, this amount increases dramatically. A significant portion of the water loss from perspiration occurs in the upper body area around the torso.

To combat the undesirable effects of perspiration, women have traditionally resorted to numerous means to eliminate or lessen the moisture and odor caused by perspiration. For instance, dress shields designed to be attached to a brassiere in the underarm area have been used for that purpose and to prevent staining. One such example is shown in U.S. Pat. No. 2,886,820 which shows a dress shield which includes a resilient body, e.g., an absorbent pad, placed within a covering having a cotton side toward the body and a moisture proof side. The covering is secured to the brassiere by fastening a center strap of the shield around one of the side bands of the brassiere and fastening front and rear straps around the shoulder straps.

Other means that women use to eliminate or lessen the moisture and odor caused by perspiration include the use of deodorizing sprays, such as perfumes and powders, such as talc. Although, perfumes work well to combat perspiration odor, they only are effective for a short period of time. When perspiration odor and perfume mix the results are usually very unpleasant. A disadvantage of powders, such as talc, is that they cake and flake after becoming moist and may filter through the blouse or dress material leaving a tell-tale wet spot.

Despite the advantages of using dress shields, perfumes, powders and the like, most women perspire at locations on their upper body other than in the underarm area. For instance, women perspire between and under their breasts. As the rivulets of perspiration run down between the breasts, heretofore there has been nothing to absorb the moisture except the brassiere itself which is pressed against the skin. In the past, women facing such unpleasantries have placed tissues sprayed with perfume or a dusting of deodorant powder in an attempt to absorb the perspiration and combat odor in the breast area inside the brassiere. By midday the breast area may be wet with perspiration and the odor wafts up and out with each body movement causing discomfort and embarrassment. In such circumstances, women are in need of fresh deodorant protection in the area at the front of the brassiere, due to anxious perspiration, hot flashes, large breasts, bust increase due to pregnancy, physical exercise, summer temperatures, and those who are overweight, obese, or very active, busy women. Thus, there exists a need to provide women with the ability to remain dry and odor-free even in the warmest of weather.

SUMMARY OF THE INVENTION

It is an object of the present invention to provide a brassiere having moisture absorbing control between and under the wearer's breasts.

Another object of the present invention is to provide a brassiere having an absorbent material which includes a deodorant attached to the brassiere between the breast cups.

Yet another object of the present invention is to provide a brassiere having a disposable, easily replaced absorbent material attached to the interior of the front of the brassiere between the breast cups.

In accordance with the present invention there is provided a brassiere having a torso encircling body portion having a frontal portion, a pair of side portions and a back portion. A pair of breast cups is located in the frontal portion on either side of an area connecting the breast cups. A moisture absorbent material is attached to the area between said breast cups. The absorbent material is preferably made of soft, nonwoven absorbent fibers. The nonwoven material may contain a super absorbing polymer to provide more moisture absorbing capacity. In a preferred embodiment, the absorbing material contains a deodorant which may be in the form of a powder, such as talc, and which may be scented or unscented. The moisture absorbent material is thin and preferably shaped to fit the contour of the brassiere between the breast cups. The absorbent material may be of different sizes and shapes depending upon the needs and desires of the wearer. In its most preferred embodiment, the moisture and odor absorbent material is attached to the inside of the brassiere using a conventional adhesive such as those used with panty liners and the like. The absorbent material may be used with any conventional type of brassiere.

Other objects, features and advantages of the present invention will become apparent from the following detailed description taken in conjunction with the accompanying drawings.

DETAILED DESCRIPTION OF PREFERRED EMBODIMENTS

Figure 1:
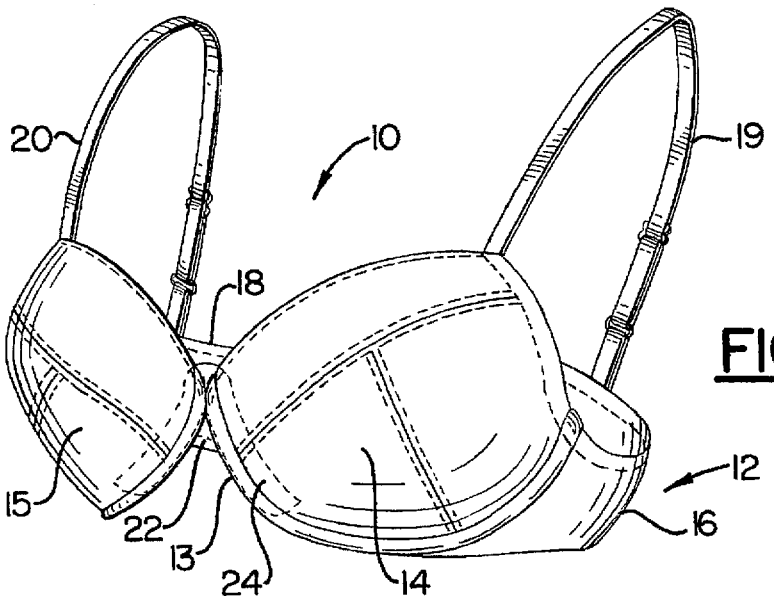
FIG. 1 is a perspective view of the present invention illustrating a preferred embodiment of a brassiere and showing the moisture absorbing material in phantom attached between the breast cups of the brassiere.

Referring now to the drawings, FIG. 1 shows a brassiere having a moisture absorbing material located at an area between the breast cups according to a preferred embodiment of the invention and represented generally at 10. The brassiere 10 includes a torso encircling body portion 12 having a frontal portion 13 and side portions 16, 17. The frontal portion 13 includes a pair of breast cups 14, 15. A pair of shoulder straps 19, 20 connect the frontal portion 13 with the back portion 18. The back portion 18 may include a pair of back straps having fasteners (not shown) for holding the brassiere in position on the wearer. The torso encircling body portion 12 includes an area 22 connecting the breast cups 14, 15. It should be readily understood that the moisture absorbing materials may be used with any conventional type of brassiere.

Figure 2:
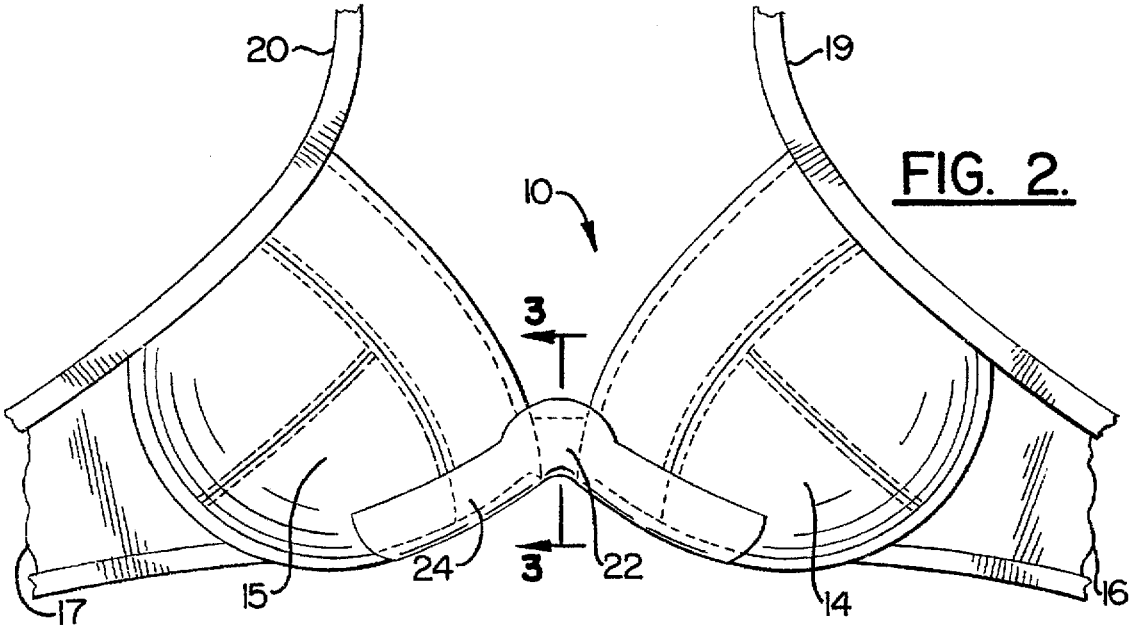
FIG. 2 is a rear view of an embodiment of the present invention illustrating the inside of a brassiere and showing the moisture absorbing material attached between the breast cups.
Figure 3:
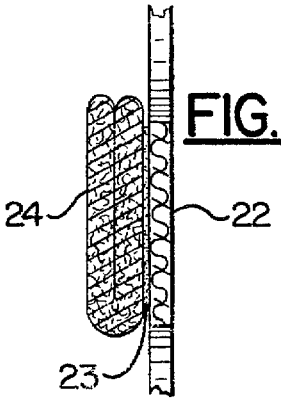
FIG. 3 is a sectional view of the present invention taken along line 3—3 of FIG. 2 illustrating an embodiment of the absorbent material attached to a brassiere.
Figure 4:
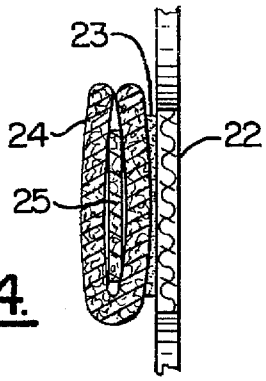
FIG. 4 is a sectional view of the present invention taken along line 3—3 of FIG. 2 illustrating another embodiment of the disposable absorbent material including a deodorant and being attached to the brassiere.

The moisture absorbing material 24 fits and contours to almost any design and style brassiere. The moisture absorbing material 24 may be made in several sizes, such as small, medium, large and extra large, or a combination of small-medium and large-extra large sizes. The absorbent material 24 is relatively thin and preferably shaped to fit the contour of the brassiere between the breast cups. As shown in FIG. 2 the absorbing material 24 is preferably contoured to follow the bottom edge of the brassiere body portion 12 to absorb more perspiration therefore affording maximum odor control. The absorbent material may be of different sizes and shapes depending upon the needs and desires of the wearer, such as circular, heart shaped, or the like.

The absorbent material 24 is preferably made of soft, nonwoven absorbent fibers. The absorbent fibers may, for example, be natural cellulose fibers from wood pulp. While any paper fibers may be used, the economically preferred end use of the products dictates the desirability for using waste or recycled paper, especially waste newsprint.

Furthermore, it is not necessary that the moisture absorbent material 24 be limited to recycled paper as any natural cellulose fibers may be used. Other natural cellulose fibers include a variety of materials such as bagrasses, hemp, jute, rice and corn stalks, cotton linters and the like. Also, other fiberized material may be used, such as natural fibers, e.g., cotton linters and synthetic moisture absorbent fibers. In addition, the absorbent material 24 may be any material similar to those used in feminine hygiene products, such as KOTEX® light days mini pads, CAREFREE® and ALWAYS® panty liners.

The moisture absorbing material 24 may contain a super absorbing polymer to provide additional moisture absorbing capacity. Super absorbent polymers are synthetic cross-linked polymeric materials that are capable of absorbing many times their own weight of water or other liquids. Because super absorbent polymers are significantly cross-linked, they are difficult to put into solution. Therefore, super absorbent polymers are most commonly used as powders or granules.

The super absorbent polymers suitable for application in the present invention are conventional super absorbent polymers as that term is commonly applied in the art. Super absorbent polymers are generally from one of three classes, namely, starch graft copolymers, cross-linked carboxymethyl cellulose derivatives and modified hydrophilic polyacrylates. Examples of such materials are polymers of water soluble acrylic or vinyl monomers that are cross-linked with a polyfunctional reactant. Also included are starch modified polyacrylic acids and hydrolyzed polyacrylonitrile and their alkali metal salts. The acrylic polymers are preferred and are commercially available in particulate form mainly as polyacrylic acid.

A number of acrylic based super absorbent polymers are commercial available and these are suitable for use in the present invention. A preferred commercially available super absorbent polymer is SANWET®, a starch modified super absorbent polymer available from Hoechst Celanese Corporation, Charlotte, N.C. SANWET® is a starch grafted polyacrylate sodium salt that has the capacity to absorb as much as 800 times its own weight in liquid. Other commercially available super absorbent polymers include, for example, DRYTECH® 520 super absorbent polymer available from Dow Chemical Co., Midland, Mich. (DRYTECH® is a super absorbent derived from polypropenoic acid); AQUA KEEP manufactured by Arakawa Chemical USA, Inc.; ARIDALL 1125 manufactured by Chemdall Corporation; and FAVOR manufactured by Stockhausen, Inc.

Among the super absorbent polymers of the carboxymethyl cellulose derivative type are carboxymethyl cellulose or an alkaline metal salt thereof, such as sodium carboxymethyl cellulose, hydroxy-ethyl cellulose, hydroxypropylomethyl cellulose, methyl cellulose, regenerated cellulose derived from solutions of cellulose xanthate, carrageenan and collagen.

In a preferred embodiment of this invention, the moisture absorbing material 24 also includes a deodorant 25 which may be in the form of a powder, such a talc, and which may be scented or unscented. The deodorant used with the moisture absorbing material 24 is the same as typically used with feminine hygiene products. By way of example, the deodorant powder may be the same as those used in such products as, VAGISIL® Feminine Powder, distributed by Combe Inc. or Johnson's Baby Powder. Also feminine deodorant sprays, or a combination of talcs, scented or unscented, medicated or unmedicated, or any moisture, odor controlling powders, talcs, cornstarch, and baking soda may be used. In addition, the moisture absorbing material 24 may contain hypo-allergenic, dermatologist and allergy tested, absorbent, odor controlling, and/or perfumed or fresh scent ingredients.

In its most preferred embodiment, the moisture and odor absorbent material 24 is attached to the inside of the brassiere at the frontal area 22 by any conventional means. In a preferred embodiment, a conventional adhesive 23, such as those used with panty liners and the like, is used wherein the adhesive is covered with a release strip until time for its use. Other means for attaching the moisture absorbent material 24 to the brassiere area 22 include, for example, VELCRO® strips, snaps, hooks, and pins. Such moisture absorbing material is a disposable product, convenient to carry in pocket or purse for quick refreshing changes during the day.

In another embodiment, a non-disposable absorbing material may be a desirable alternative to some women wherein a pouch or pocket is attached to the brassiere at area 22 and the material 24 is inserted into the pocket pouch. The pocket or pouch may be made with a tuck-away flap to hold the deodorant or absorbent, odor controlling substance inserted into the pocket or pouch, or a brassiere with a non-detachable insert. In this embodiment, a pocket or pouch is easily incorporated into the construction of the brassiere.

In the drawings and specification there has been set forth a preferred embodiment of the invention, and although specific terms are employed, they are used in a generic and descriptive sense only and not for purposes of limitation, the scope of the invention being defined in the claims.

What is claimed is:

1. A brassiere comprising:

a torso encircling body portion having a frontal portion, side portions and a back portion, a pair of breast cups located in said frontal portion, an area connecting said breast cups; and an easily removable and replaceable moisture absorbent material shaped to fit and adhesively attached to the area between said breast cups and extending under at least a portion of each breast cup, said material being relatively more absorbent than said frontal portion for absorbing perspiration.

2. The brassiere according to claim 1 further comprising a pair of shoulder straps.

3. The brassiere according to claim 1 wherein said adsorbent material includes a deodorant.

4. The brassiere according to claim 1 wherein said absorbent material comprises nonwoven fibers.

5. The brassiere according to claim 1 wherein said moisture absorbent material further comprises a super absorbent polymer.

6. The brassiere according to claim 1 wherein said deodorant is a non-scented powder.

7. The brassiere according to claim 1 wherein said deodorant is a scented powder.

8. The brassiere according to claim 1 wherein said deodorant is a perfume.

9. A brassiere comprising:

a torso encircling body portion having a frontal portion, side portion and a back portion, a pair of breast cups located in the front of said body portion, an area connecting said breast cups; and a disposable moisture absorbent material of nonwoven fibers having a greater absorbency than said frontal portion attached to the area between said breast cups and extending under at least a portion of each breast cup, said absorbent material containing a deodorant.

10. The brassiere according to claim 9 wherein said moisture absorbent material further comprises a super absorbent polymer.

* * * * *